United States Patent [19]

Sakurai et al.

[11] 4,113,635

[45] Sep. 12, 1978

[54] RUST-PROOF LUBRICANT COMPOSITIONS

[75] Inventors: Toshio Sakurai, Yokohama; Shoji Shimada; Yoshiharu Kamimura, both of Kitakyushu, all of Japan

[73] Assignee: Nippon Steel Corporation, Tokyo, Japan

[21] Appl. No.: 710,312

[22] Filed: Jul. 30, 1976

Related U.S. Application Data

[63] Continuation of Ser. No. 528,885, Dec. 2, 1974, abandoned, which is a continuation-in-part of Ser. No. 314,503, Dec. 13, 1972, abandoned.

[30] Foreign Application Priority Data

Dec. 13, 1971 [JP] Japan ..... 46-100881

[51] Int. Cl.[2] ..... C10M 3/02; C10M 7/02; C10M 7/20

[52] U.S. Cl. ..... 252/49.6; 252/56 S; 252/51.5 R

[58] Field of Search ..... 252/49.6, 56 S

[56] References Cited

U.S. PATENT DOCUMENTS

| | | | |
|---|---|---|---|
| 2,564,422 | 8/1951 | Barnum | 252/34 |
| 2,856,299 | 10/1958 | Westlund, Jr. | 106/14 |
| 2,893,880 | 7/1959 | Dieman | 106/14 |
| 2,911,309 | 11/1959 | Rudel et al. | 106/14 |
| 3,080,330 | 3/1963 | Rudel et al. | 260/18 |
| 3,189,629 | 6/1965 | Huttenlocher | 260/404.8 |
| 3,247,111 | 4/1966 | Oberright et al. | 252/34.7 |
| 3,321,506 | 5/1967 | Knowles et al. | 260/462 |
| 3,360,465 | 12/1967 | Warman | 252/56 |
| 3,526,596 | 9/1970 | Kress et al. | 252/49.5 |
| 3,950,341 | 4/1976 | Okamoto | 252/49.6 X |

*Primary Examiner*—Delbert E. Gantz
*Assistant Examiner*—J. Thierstein
*Attorney, Agent, or Firm*—Toren, McGeady and Stanger

[57] ABSTRACT

Rust-proof lubricant compositions for coating metals comprising mono, di- or tri-partial esters synthesized from pentaerythritol and fatty acids having more than 6 carbon atoms including the corresponding isomers, or a mixutre thereof as chief constituents.

3 Claims, 1 Drawing Figure

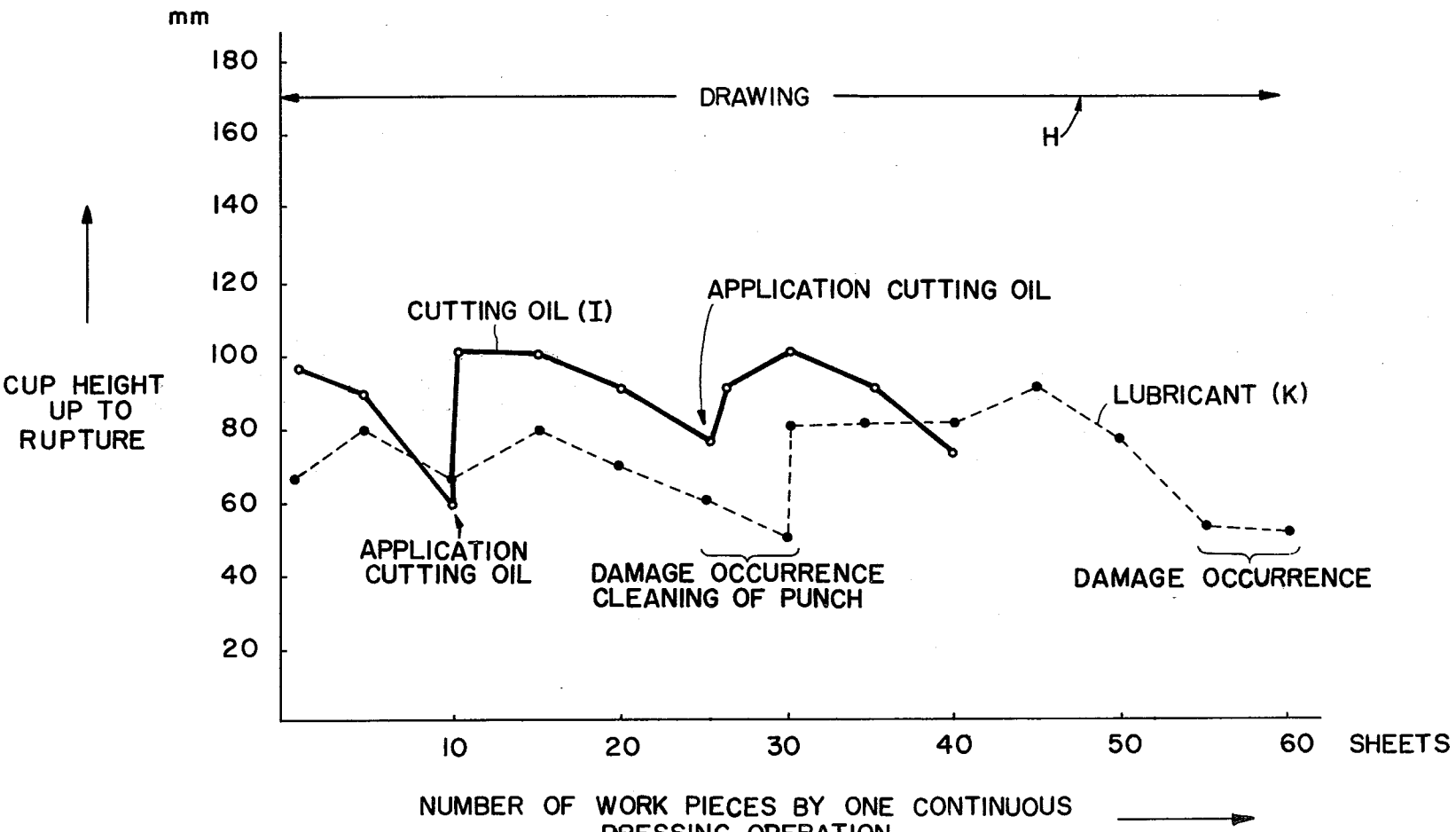
DRAWING
H
mm
180
160
140
120
100
80
60
40
20
CUP HEIGHT UP TO RUPTURE
CUTTING OIL (I)
APPLICATION CUTTING OIL
LUBRICANT (K)
APPLICATION CUTTING OIL
DAMAGE OCCURRENCE CLEANING OF PUNCH
DAMAGE OCCURRENCE
10
20
30
40
50
60
SHEETS
NUMBER OF WORK PIECES BY ONE CONTINUOUS PRESSING OPERATION

RUST-PROOF LUBRICANT COMPOSITIONS

This is a Continuation of application Ser. No. 528,885, filed Dec. 2, 1974, now abandoned which, in turn is a Continuation-in-Part of application Ser. No. 314,503, filed Dec. 13, 1972, now abandoned.

BACKGROUND OF THE INVENTION

1. Field of the Invention

This invention relates to rust-proof lubricant compositions of the solid film type for use with metals which are applied on the surfaces of hot rolled steel plates, cold rolled steel plates and surface treated steel plates (hereinafter abbreviated as "steel plates") to effect temporary rust-proofness of the steel plates and/or an improvement in lubrication at the time of forming. More particularly, the present invention is directed to rust-proof lubricant compositions comprising partial esters of pentaerythritol with fatty acid, as the chief constituents, rust-preventitives, lubrication-improving agents, surface active agents, etc., having melting points of 30°-60° C, which can be applied on steel plates without the necessity of any solvent or heat-drying, and which may be adapted for the continuous coating of steel plates.

2. Description of the Prior Art

In general there are two types of compositions which are used to effect a temporary rust-prevention and/or forming lubrication of steel plates, one of which is the liquid film type, contains components capable of improving the rust-proof and lubrication added into a base oil, for example, mineral oil, animal oil, or vegetable oil, such as, metal working oil, anti-rusting oil, etc., and the other of which is of the solid film type and contains a fatty acid, or fatty acid soap as the main constituents.

In comparing both types, the liquid coating has the disadvantage that when the steel plates are fabricated by press forming, some of the coating drops onto the floor and a dangerous slipping hazard exists. Moreover, the environment is polluted by the bad odor and scattering of the liquid which soils the clothes of the operators. Also, the formability can not be kept constant because the coating can not be held for long periods in the quality or the quantity necessary for forming. On the other hand, the solid coating does not present such problems. But the known solid coating composition should be dissolved in hot water, or an organic solvent before use, and the steel plates coated with the solution should be heated to dryness to remove the water or the solvent.

On one hand, the solid coating has a better effect on the stamping than the liquid coating as mentioned above. But, on the other hand, the coating process prior to the forming is more complicated, and requires facilities for coating and for drying by heating. Further, the heating lowers the quality of the steel sheet itself due to the strain ageing effect, so that it is not common to apply the solid coating in place of the liquid coating.

However, with the steel plate makers manufacture steel plates coated with rust-proof lubricant compositions of the solid film-type, users can directly place the coated steel plate into the forming operation without encountering the above-mentioned problems so that improvements in the operating conditions and productivity to counterbalance the additional costs will be easily achieved.

The rust-proof lubricants of the solid film-type are classified as of the solvent-type, aqueous solution-type, and reaction-type.

As for the solvent-type, the principal constituents, such as, fatty acid, extreme pressure additives, rust-preventives, etc., should be dissolved in an organic solvent before applying it on steel plates. In the case of the aqueous solution type, the principal constituents which are metal soaps of fatty acid and certain water-soluble organic compounds and inorganic compounds should be dissolved in hot water, and the coating applied on metal plates is dried by heating to form the solid film. In the reaction type, there is a lubricant comprising a phosphate-fatty acid soap. However, these conventional rust-proof lubricant compositions of the solid film type have many disadvantages, e.g.:

(1) The solvent-type uses an organic solvent so that when a large amount of the composition is used, for example, in the process for coating coils of steel sheets continuously, there arise the dangers from fire and explosion, sanitary problems, and special facilities are thus made necessary. Even if a highly noncombustible solvent is used, operators will not be free from the sanitary problems, such as, bad odor, poisoning by solvent, etc. Further, the waste gases produced when drying presents pollution problems. Additional problems include difficulty in degreasing in a short period of time in the surface-treating step after the forming operation.

(2) The aqueous solution type does not have the above-mentioned dangers from fire, or poisoning by solvent, because of the use of water, but high temperatures and long periods of time are necessary for drying, so that it is not only difficult to apply at a high speed on coils of steel plates, but also it is unsuitable to use for aging steel plates of which the mechanical properties are lowered by heating. Furthermore, since there is a close relationship between the melting point of compositions of the solid film-type and the pressing formability, the conventional water-soluble solid coatings are, in most cases, composed of compounds having high melting points, such as, fatty acid soaps and do not melt at the time of stamping. In drawing process, coating film is rubbed off with die surface and especially by die throat, and then splits of the coating film pile on die surface which hinders the steel plates from sliding into the dies. Further, the film does not have the fluidity to cover again the naked surface rubbed off by the drawing in larger sizes, therefore, cause pressing damages or reduce the pressing formability.

(3) The reaction-type complicates both the coating treatment and the subsequent removal treatment.

As has been mentioned above, while the conventional rust-proof lubricants of the solid film-type have many defects, the present invention overcomes all of these defects and provides compositions having very important properties.

BRIEF DESCRIPTION OF THE DRAWING

The drawing is a graph of formability of steel sheets during a continuous pressing operation.

SUMMARY OF THE INVENTION

The feature of the coating compositions of this invention will become more apparent upon consideration of the following description. In summary, the present invention resides in a coating composition which possesses, not only a very excellent rust-proof action and lubricity as compared with the conventional compositions which have been used to give steel plates some rust-prevention and working lubrication, but also, no danger of fire, explosion, or poisoning, by solvent is present since neither solvent nor heat-drying is used when coating. Further, the rust-proof and lubricant coatings can be constantly maintained and thus, production lines, e.g., the forming operation, can be kept at extremely good efficiency.

Namely, by having taken into due consideration the problems associated with the conventional lubricants, the present inventors have found rust-proof and lubricative coating compositions of the solid film type which contain more than about 40% by weight of the partial esters of pentaerythritol of a fatty acid as the main constituents, which are water-insoluble and which require no solvent and no hot air drying.

The reason why the present inventors selected the partial ester of pentaerythritol of a fatty acid is based mainly on the following facts. The partial ester of pentaerythritol of a fatty acid has hydroxyl groups together with ester groups, and their configuration is of the tetrapod type, so that the adsorption strength to the metal surface is strong and the sliding lubrication is remarkably excellent as compared with glycerid, for example, palm kernel oil, and commercial metal working oils. Moreover, most of the partial esters of pentaerythritol of a fatty acid have melting points of less than 60° C, and their viscosity in melt is lower, being different from those of the polymers. With these properties, they can be easily applied on steel plates, and can be used for the continuous coating operation of steel plates by the usual coating method, such as, roll coating, or spray coating.

DESCRIPTION OF THE PREFERRED EMBODIMENT

The partial esters used in the present invention are produced by esterification reactions of pentaerythritol and fatty acid using conditions which are well known and conventional in the art.

Preferably fatty acids to produce the corresponding partial esters by the reaction with pentaerythritol are ones saponified from animal oils, such as, beef tallow, lard, mutton tallow, etc., ones produced from vegetable oil, such as, rape oil, castor oil, palm kernel oil, etc., and straight-chain fatty acids, such as, capric acid, undecanoic acid, lauric acid, myristic acid, palmitic acid, stearic acid, and also olefinic fatty acid, such as, oleic acid, and naphthenic acid and iso-fatty acid, etc. The mono, di- and tri-substituted esters are more preferable than the esters produced by esterifying all of the four hydroxyl groups. These partial esters are used in the form of mixtures in industry.

The amount of the partial ester used in the composition should be greater than about 40% by weight, otherwise, the lubricating effect obtained is not satisfactory. Preferably, the amount of partial ester is greater than about 50% by weight of the total composition.

The partial ester of pentaerythritol of a fatty acid alone may be used satisfactorily as a lubricant of the solid film type for the forming operation, but for the purpose of improving the rust-prevention and lubrication, there may be added some rust-preventives and some lubrication-improving agents of the reaction-type. As for the useful rust-preventives, it may be any of the rust-preventives that are soluble in the partial ester of pentaerythritol, for example, organic amine compounds, such as, dicyclohexylamine, triethanolamine, etc., petroleum sulfonates, such as, petroleum sodium sulfonate, petroleum, calcium sulfonate, etc., and oxidized paraffins. The amount of a rust-preventive added is not particularly limited, but is preferably about 0.5 – 20% by weight based on the composition. For the further improvement of lubrication, any of the extreme pressure additives that are soluble in the partial ester may be added. Examples of the extreme pressure additives which is soluble in the coating composition of this invention are chlorinated paraffin, trichloroethyl phosphate, tricresyl phosphate, trialkyl phosphate, and polyoxyethylene alkyl (or aryl) ether phosphate. As the other additives, there may be added any known viscosity-increasing agent, pour point depressant, antifoaming agent and surface tension depressant, and oil-stain preventives. As for the oil-stain preventives, paranitrophenyl, zinc-dialkyldithio phosphate, α-phenylnaphthylamine, naphthol, paranitro-benzoic acid, α-naphthylaine, diphenylamine, para-aminophenol, α-nitronaphthalene, para-phenylene diamine, di-phenylphenylene diamine, dinaphthylpara-phenylene diamine, tetra-methyl diamino diphenyl methane, di-tertiary-butylparacresol, di-tertiary-amylhydroquinone, di-tertiary-butylhydroquinone, butylidene-bis-tertiary-butylmethacresol, alkyldithiophosphates and boroxisarophenanthrene derivatives may be used.

The applicability of the coating compositions of this invention on the surfaces of steel plates is such that the composition of this invention can be readily liquified by heating, and the liquid composition can be continuously applied on coils of steel plates by the roll coating or spray coating method, and when the coating is cooled by contact with cold air, the coated steel plates are easily obtained there.

The thus-coated steel plates of this invention are far more excellent in drawing lubrication, rust-prevention and degreaseability than those coated with the conventional metal working oils, or lubricants of the solid film-type. In the continuous stamping operation, depression in drawing performance are observed in the case of the conventional coatings of liquid film-type and of the metal soap type, while the continuous stamping performance with the coating composition of this invention is always excellent and stable, as shown in the figure.

Therefore, automobile manufactures and household electric goods makers who employ continuous stamping operations can increase their productivities remarkably and improve their work environments by using the steel plates coated with the composition of this invention owing to the stability of the drawing formability.

The coating compositions of this invention may be applied on metal plates of stainless steel, aluminum, zinc and iron as well as on hot rolled steel plates, cold rolled steel plates and surface-treated steel plates.

EXAMPLE 1:

The coating compositions of this invention listed in Table 1 are independently liquidifed by heating to 70° C; and applied continuously on coils of degreased coil rolled steel plates (of 0.8 mm thick) each in an amount of 1–2 g/m$^2$ by spray coating. Immediately on applying by the spray coating, the thickness of the coating is uniformalized by use of hot rolls maintained at a temperature of 75°–80° C, and cold air is sprayed without delay into the steel plates which are then taken up into a coil.

The thus-coated steel plates were subjected to a pressing formability test, and the results are shown in Table 1.

As controls, samples for the test are prepared by applying a commercial metal working oil and two lubricants ot the solid film type, one of which requires the use of a solvent, and the other of which is composed of a soap, in their respective normal manners.

Table 1

Performance of coating lubricant compositions of this invention

Composition of pentaerythritol partial ester

| No. | Fatty acid or its source | Monoester (%) | Diester (%) | Triester (%) |
|---|---|---|---|---|
| A | Stearic acid | 10 | 86 | 4 |
| B | Stearic acid | 10 | 86 | 4 |
| C | Fish oil fatty acid | 31 | 44 | 25 |
| D | Fish oil fatty acid | 31 | 44 | 25 |
| E | Coconut oil fatty acid | 20 | 10 | 70 |
| F | Coconut oil fatty acid | 20 | 10 | 70 |
| G | Hydrogenated beef tallow fatty acid | 5 | 80 | 15 |
| H | Hydrogenated beef tallow fatty acid | 5 | 80 | 15 |

Composition of lubricant

| No. | Pentaerythritol partial ester | Rust-preventive | The other additives |
|---|---|---|---|
| A | 95 | Dicyclohexyl-amine 5% | None |
| B | 85 | Dicyclohexyl-amine 5% | Polyoxyethylene alkyl ether phosphate 10% |
| C | 85 | Dicyclohexyl-amine 5% | Mineral oil 10% |
| D | 85 | Dicyclohexyl-amine 5% | Tricresyl phospate 10% |
| E | 95 | Dicyclohexyl-amine 5% | None |
| F | 85 | Dicyclohexyl-amine 5% | Trichloroethyl phospate 10% |
| G | 95 | Dicyclohexyl-amine 5% | None |
| H | 85 | Dicyclohexyl-amine 5% | Polyoxyethylene alkyl ether phosphate 10% |

Performance

| No. | Formability (mm) | Rust-prevention | Degreaseability |
|---|---|---|---|
| A | 163 | oo | oo |
| B | Draw fit | oo | oo |
| C | 162 | oo | oo |
| D | Draw fit | oo | oo |
| E | 160 | oo | oo |
| F | 167 | oo | oo |
| G | 168 | oo | oo |
| H | Draw fit | oo | oo |

Table 2

Performance of coating composition on the market

| Composition | Film-type | Form-ability | Rust-prevention | Degrease-ability |
|---|---|---|---|---|
| I metal working oil (Commercial drawing lubricant) | Liquid | 105 | Δ | x |
| J Solvent-type | Solid | 148 | x | x |
| K Fatty-acid soap-type | " | 73 | o | oo |

Note:
(1) Rusting test: A weathering test was carried out for 15 days in an atmosphere of 80% humidity at 35° C.
Criterion
oo:less than 0.1% Rust
o:0.1 – 5% Rust
Δ:6 – 30% Rust
x:more than 31% Rust
(2) Degreasing test: Samples prepared by applying the lubricants independently were tested after they had been allowed to stand for one month in an atmosphere of 80% humidity at 40° C.

A cleaner solution containing 2% of a degreasing agent, Fine Cleaner #353 made by Nihon Parkerizing Co., Ltd. is sprayed onto the samples at the pressure of 1 kg/cm$^2$, 2 minutes.

Criterion: The degreaseability is estimated by measuring percentage of a water wettable area after the washing.

oo : 100%
o : 81 – 99%
x : below 80% 6 * The pressing test for determining the formability was carried out using steel disks (blanks), 480 mm diameter, cut out from their respective lubricant-coated steel plates.

The formability is evaluated by the height at which the blank steel is broken by the pressing with a spherical heat punch having a diameter of 200 mm, using a 150-ton press tester (blank holder pressure 10 ton).

EXAMPLE 2

A number of steel plates coated with coating composition H of this invention mentioned in Example 1 and with commercial lubricant I or K on the market are pressed under the same condition as the above.

The results are illustrated in the figure, from which it is understood that the metal plates coated with the lubricant composition of this invention can be subjected to a continuous pressing operation without any trouble, while the metal plates coated with I or K can not be subjected to a similar continuous pressing operation unless several oil-supplies and cleanings are carried out during the operation.

EXAMPLE 3

| | |
|---|---|
| Hydrogenated beef tallow fatty acid pentaerythritol esters : | 70 parts |
| Mono-ester 20% | |
| Diester 30% | |
| Triester 40% | |
| Tetraester 10% | |
| Beeswax | 15 parts |
| Sebacid acid diester | 11 parts |
| Oleic acid polyethylene glycol | 3 parts |
| α-phenylnaphthylamine | 1 part |

EXAMPLE 4

| | |
|---|---|
| Beef tallow fatty acid pentaerythritol esters | 40% (by weight) |
| Monoester 40% | |
| Diester 30% | |
| Triester 20% | |
| Tetraester 10% | |
| Di-isododecylphthalate | 20 parts |
| Hydrogenated soybean oil | 15 parts |
| Alkylphenolethyleneoxide | |

-continued

| | |
|---|---|
| phosphoric acid ester | 5 parts |
| Methylene bis methyl tertiary butyl phenol | 2 parts |
| Triethanol amine | 1 part |
| Dicyclohexylamine | 2 parts |

EXAMPLE 5: (comparative)

| | |
|---|---|
| Beef tallow | 97 parts |
| Alkylphenol polyethylene oxide | 2 parts |
| Oxidization preventive | 1 part |

EXAMPLE 6: (comparative)

| | |
|---|---|
| Beef tallow fatty acid pentaerythritol ester : | 8 parts |
| Monoester 30% | |
| Diester 35% | |
| Triester 35% | |
| Lard | 82 parts |
| Dicyclohexylamine | 3 parts |
| Oleic acid polyloxyethylene oxide | 5 parts |
| Oxidizaton preventive | 2 parts |

The compositions of Examples (3) – (6) were coated on SPC steel sheet in an amount of 1 g/m$^2$ and the qualities of thus obtained rust-proof lubricated steel sheets are shown on Table 3.

Table 3

| | Degreasing ability | Rust Preventiveness | Oil stain | Press Lubricity |
|---|---|---|---|---|
| Example 3 | Complete | No rust | No | Good |
| Example 4 | Complete | No rust | No | Good |
| Example 5 | Not satisfactory | Rust | Cloud-like oil stain | −145 mm not good |
| Example 6 | Not satis- | No rust | No | −150 mm |

Table 3-continued

| | Degreasing ability | Rust Preventiveness | Oil stain | Press Lubricity |
|---|---|---|---|---|
| | factory | | | not good |

We claim:

1. In a rust-proof lubricant composition of the solid-film type which is composed of a major amount of a base oil and not more than 10 percent of at least one member selected from the group consisting of phenol oxidization preventives, amine oxidization preventives, boron oxidization preventives, non-ionic, anionic and cationic surface active agents, the improvement which comprises said base oil consisting of the partial ester obtained by the esterification reaction between a fatty acid and pentaerythritol selected from the group consisting of mono, di- and tri-esters, said partial ester being present in an amount of at least about 40% by weight of the composition.

2. The composition of claim 1 wherein the fatty acid has 6 or more carbon atoms including the corresponding isomers.

3. A rust-proof lubricant composition comprising a. not less than 40% of at least one of mono-ester, di-ester and tri-ester obtained by reaction between a fatty acid and pentaerythritol, b. not more than 10% of at least one member selected from the group consisting of phenol oxidization preventives, amine oxidization preventives and boron oxidization preventives, c. 10% of at least one member selected from the group consisting of non-ionic, anionic and cationic surface active agents, and d. from 0.5 to 20% of at least one member selected from the group consisting of dicyclohexylamine, triethanol amine, petroleum sulfonates and oxidized paraffins, and e. the balance being at least one member selected from the group consisting of viscosity increasing agents, mineral oils and melting point depressants.

* * * * *